US006499689B1

(12) United States Patent
Miyazaki

(10) Patent No.: US 6,499,689 B1
(45) Date of Patent: Dec. 31, 2002

(54) WIRE WINDING APPARATUS AND METHOD

(75) Inventor: Hiroshi Miyazaki, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/531,331

(22) Filed: Mar. 20, 2000

(30) Foreign Application Priority Data

Mar. 29, 1999 (JP) ..... 11-086216
May 17, 1999 (JP) ..... 11-135770

(51) Int. Cl.[7] ..... B65H 54/28; B65H 59/36; H01C 17/04

(52) U.S. Cl. ..... 242/478.1; 242/411; 242/437.3; 242/447.1

(58) Field of Search ..... 242/478.1, 157.1, 242/437.3, 447.1, 411

(56) References Cited

U.S. PATENT DOCUMENTS 1,504,005 A * 8/1924 Vienneau ..... 242/478.1 X
1,817,884 A * 8/1931 Vienneau ..... 242/447.1
3,237,875 A * 3/1966 Van Der Hoek et al. 242/478.1 X
4,150,801 A * 4/1979 Ikegami et al. ..... 242/478.1
4,244,539 A * 1/1981 Taneda et al. ..... 242/478.1
4,480,799 A * 11/1984 Yano et al. ..... 242/412
4,483,496 A * 11/1984 Weinlich ..... 242/478.1
4,484,712 A * 11/1984 Leenders ..... 242/478.1
5,564,637 A * 10/1996 Berthold et al. ..... 242/157.1 X
5,681,006 A 10/1997 Herd et al.

FOREIGN PATENT DOCUMENTS

DE 2951917 C2 6/1980
JP A 61-84010 4/1986
JP 64-43046 2/1989
JP 7-183152 7/1995

* cited by examiner

*Primary Examiner*—Michael R. Mansen
(74) *Attorney, Agent, or Firm*—Oliff & Berridge, PLC

(57) ABSTRACT

A wire winding apparatus produces a coil of a desired shape quickly and inexpensively. An element wire to be wound on a winding frame is supported while a predetermined tension is applied to the element wire. When the element wire is shifted from a turn to another turn during the winding of the element wire around the winding frame, the element wire is regularly aligned by utilizing the tension applied to the element wire.

17 Claims, 14 Drawing Sheets

WIRE WINDING APPARATUS AND METHOD

INCORPORATION BY REFERENCE

The disclosures of Japanese Patent Application Nos. HEI 11-086216 filed on Mar. 29, 1999, and HEI 11-135770 filed on May 17, 1999 including their specifications, drawings and abstracts are incorporated herein by reference in their entireties.

BACKGROUND OF THE INVENTION

1. Field of Invention

The present invention relates to a wire winding apparatus and, more particularly, to a wire winding apparatus for producing a coil by winding an element wire, and to a coil producing method.

2. Description of Related Art

A known wire winding apparatus has two rollers that are disposed in a sandwich positional relationship relative to a winding frame to guide an element wire so that the element wire wound on the winding frame in proper alignment is prevented from shifting sideways.

Another wire winding apparatus has been proposed (in, for example, Japanese Patent Application Laid-Open No. SHO 64-43046) which has members for guiding an element wire to be wound. In this apparatus, two guide members are disposed in a sandwich positional relationship relative to a winding frame. When an element wire is wound on the winding frame, the guide members are alternately shifted by one pitch in a direction of the winding process.

However, both the wire winding apparatus described above have a problem of failing to wind an element wire on a winding frame with a high winding density. More specifically, when the winding of an element wire is shifted from one turn to the next turn, a small gap is formed between the turns of the element wire. Each of the aforementioned apparatus guides and holds an element wire wound on the winding frame in proper alignment, but does not guide or hold an "S"-curved portion of the element wire that is needed for a turn shift of the winding. Therefore, a gap is formed at the position of a turn shift. Such gaps lead to a reduced number of times that the element wire can be wound, that is, a reduction in the number of turns of a coil to be formed. Employment of such a coil in an appliance (or machine), such as an electric motor, an electric generator or the like, adversely affects the performance of the appliance (or machine).

SUMMARY OF THE INVENTION

Accordingly, it is an object of the invention to produce a desired coil at high speed and a low cost. It is another object of the invention to shift an element wire from one turn to the next turn while properly aligning the turns of the element wire. It is still another object to align turn shift portions of an element wire while adopting a simple apparatus construction that does not require replacement of component parts and, therefore, improve the productivity corresponding to omission of an alignment tool replacing time. It is a further object to provide an apparatus capable of accomplishing the aligned winding of a thick rectangular wire on a trapezoidal bobbin or formation of a pyramidal coil with proper alignment, which cannot be accomplished by conventional general-purpose bobbin winding apparatus.

To achieve one or more of the aforementioned and/or other objects, an aspect of the invention provides a wire winding apparatus for forming a coil by winding an element wire. The apparatus includes a winding frame which is rotatable and on which the element wire is wound during rotation of the winding frame. The apparatus also includes an element wire support that is movable in a direction of a rotating axis of the winding frame, and that supports the element wire and applies a predetermined tension to the element wire. The apparatus further includes a turn shift portion shaper that contacts the element wire and forms a turn shift portion in the element wire by utilizing the tension applied to the element wire by the element wire support, when the element wire is shifted from a turn to another turn during winding of the element wire around the winding frame.

The above-described apparatus is capable of aligning turn shift portions of the element wire with good regularity. Since the apparatus forms turn shift portions by utilizing the tension applied to the element wire, the apparatus construction can be simplified. Furthermore, if the turn shift portion shaper in the invention is prepared as an add-on kit, an apparatus according to the invention can be realized easily by improving the element wire supporting device of a general-purpose bobbin winding apparatus through the use of the add-on kit.

In the wire winding apparatus described above, a site of the turn shift portion shaper that contacts the element wire may be movable within a predetermined range of space adjacent to the winding frame. Therefore, when the element wire winding layer is changed, the direction of contact of the turn shift portion shaper with the element wire can be changed, so that there is no need to replace a component part for forming a turn shift portion. As a result, a coil can be produced at high speed and low cost, thereby improving the production efficiency.

Furthermore, the above-described apparatus may further have a construction in which a rotational position of the winding frame is detected and, based on a value detected thereby, the driving of the element wire support and the turn shift portion shaper is controlled. This construction makes it possible to more reliably form a turn shift portion at a proper position and therefore speedily form a coil.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described hereinafter with reference to the accompanying drawings.

Figure 1:
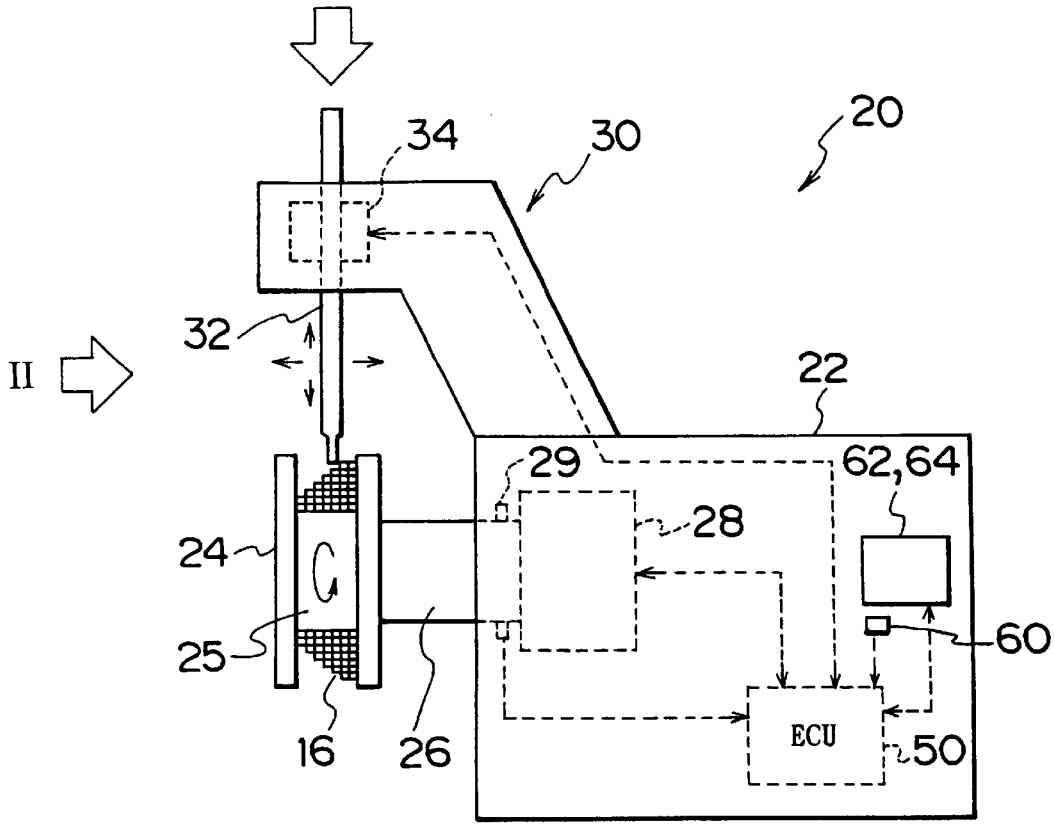
FIG. 1 is a schematic illustration of a construction of a wire winding apparatus according to a preferred embodiment of the invention.
Figure 2:
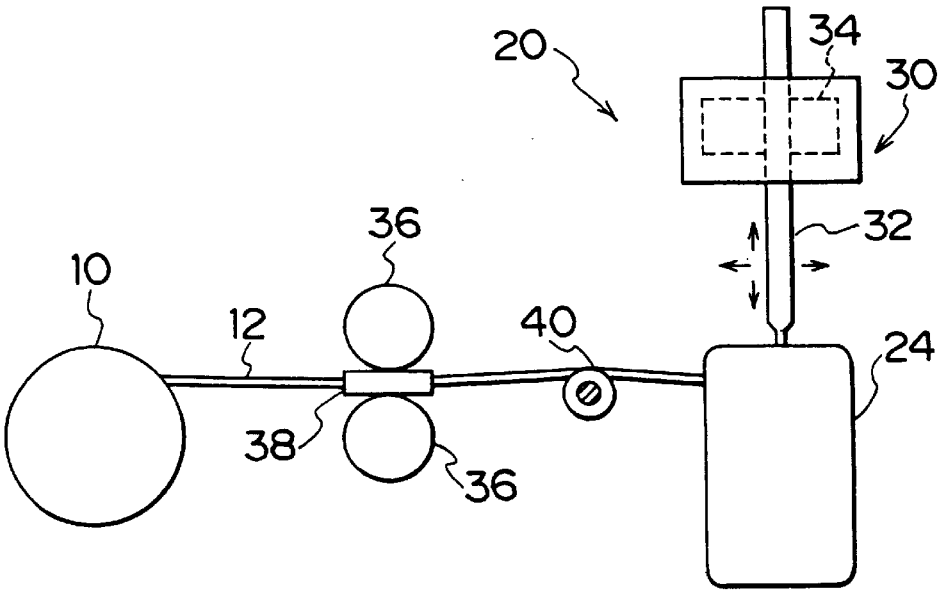
FIG. 2 is a schematic illustration of the wire winding apparatus shown in FIG. 1, viewed in a direction indicated by an arrow II.
Figure 3:
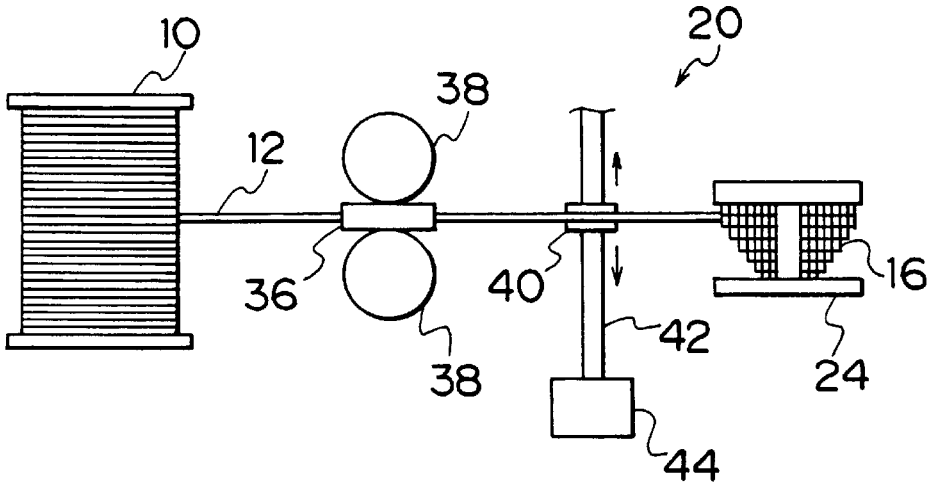
FIG. 3 is a schematic illustration of the wire winding apparatus shown in FIG. 1, viewed in a direction indicated by an arrow III.

FIG. 1 is a schematic illustration of an overall construction of a wire winding apparatus 20 according to a preferred embodiment of the invention. FIGS. 2 and 3 are schematic illustrations of the wire winding apparatus 20 shown in FIG. 1, viewed in directions indicated by an arrow II (from a side) and an arrow III (from above) in FIG. 1, respectively. As shown in FIGS. 1 through 3, the wire winding apparatus 20 has a base 22, a winding frame 24 on which an element wire 12 supplied from an element wire bobbin 10 is wound, two pairs of rolling rollers 36, 38 for providing a predetermined tension onto the element wire 12 to be wound on the winding frame 24 and forming the element wire 12 into a rectangular element wire, a guide roller 40 for guiding the rectangularly formed element wire 12 toward the winding frame 24, an aligner unit 30 for aligning the element wire 12 on the winding frame 24 and shifting the element wire 12 from a turn to the next turn during a winding process, and an electronic control unit (ECU) 50 for controlling the entire wire winding apparatus 20.

As shown in FIG. 1, the winding frame 24 is held by a spindle 26 that is rotatably supported to a shaft of a spindle motor 28 that is housed in the base 22. A resolver 29 for detecting rotation of the spindle motor 28 is mounted adjacent to a connecting portion of the spindle 26 to the spindle motor 28. Based on detection data provided by the resolver 29, the rotational position of the winding frame 24 is detected. The winding frame 24 has a central core 25. The element wire 12 is wound on the core 25 to form a coil 16. The winding frame 24 is replaceable in accordance with the size and shape of the coil 16. The embodiment shown in FIGS. 1 and 3 as a typical example employs a type of winding frame 24 that is suitable for forming a pyramidal coil 16 from a wire having a rectangular sectional shape.

The aligner unit 30 has an aligning rod 32 whose distant end portion contacts a side face of the element wire 12, and an actuator 34 that moves the aligning rod 32 within a predetermined range of space adjacent to the winding frame 24. The aligning rod 32 is supported to the actuator 34 so that the aligning rod 32 is movable in directions of three axes. The distal end portion of the aligning rod 32 has a sloping edge so as to avoid damaging the element wire 12 when contacting the element wire 12. The distal end portion of the aligning rod 32 has a cylindrical shape having a length that is about two to three times the width of the element wire 12. The manner of supporting the aligning rod 32 may be any manner as long as it allows the aligning rod 32 to be moved in directions of three axes. For example, ball splines or guide rails may be employed to support the aligning rod 32. Movements of the aligning rod 32 caused by the actuator 34 will be described later.

The guide roller 40 is supported to a roller shaft 42 as shown in FIG. 3. The roller shaft 42 is connected at an end belonging to an actuator 44 that is capable of moving the roller shaft 42 in the directions of a rotating axis of the winding frame 24 (vertical directions in FIG. 3). Therefore, the guide roller 40 is moved together with the roller shaft 42 in the directions of the rotating axis of the winding frame 24.

Figure 4:
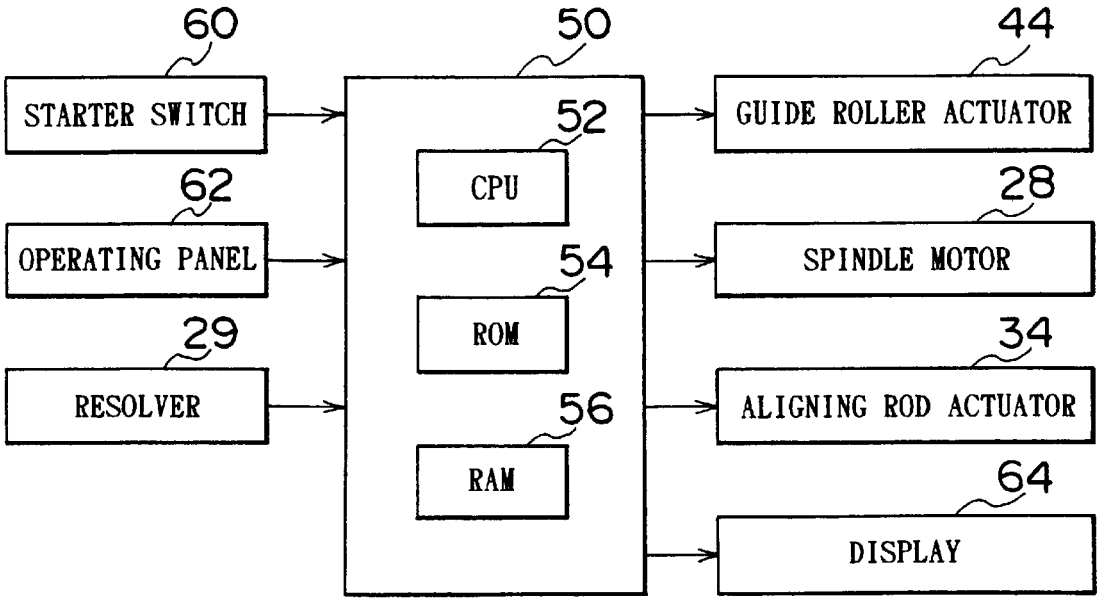
FIG. 4 is a block diagram illustrating electric signals input to and output from an ECU of the wire winding apparatus.

FIG. 4 is a block diagram illustrating electric signals input to and output from the ECU 50. The ECU 50 is formed as a one-chip microprocessor having a CPU 52 as a central component. The ECU 50 further has a ROM 54 storing processing programs and a RAM 56 for temporarily storing data, and input and output ports (not shown). The ECU 50 receives, via input ports, a start signal from a starter switch 60 that is mounted to the base 22 for starting the winding of the element wire 12, an input signal from an operating panel 62, a rotational position signal from the resolver 29, and the like. The ECU 50 outputs, via output ports, drive signals to the actuator 44 of the guide roller 40, the spindle motor 28, and the actuator 34 of the aligning rod 32, image signals to a display 64 disposed in the operating panel 62, and the like.

Figure 5:
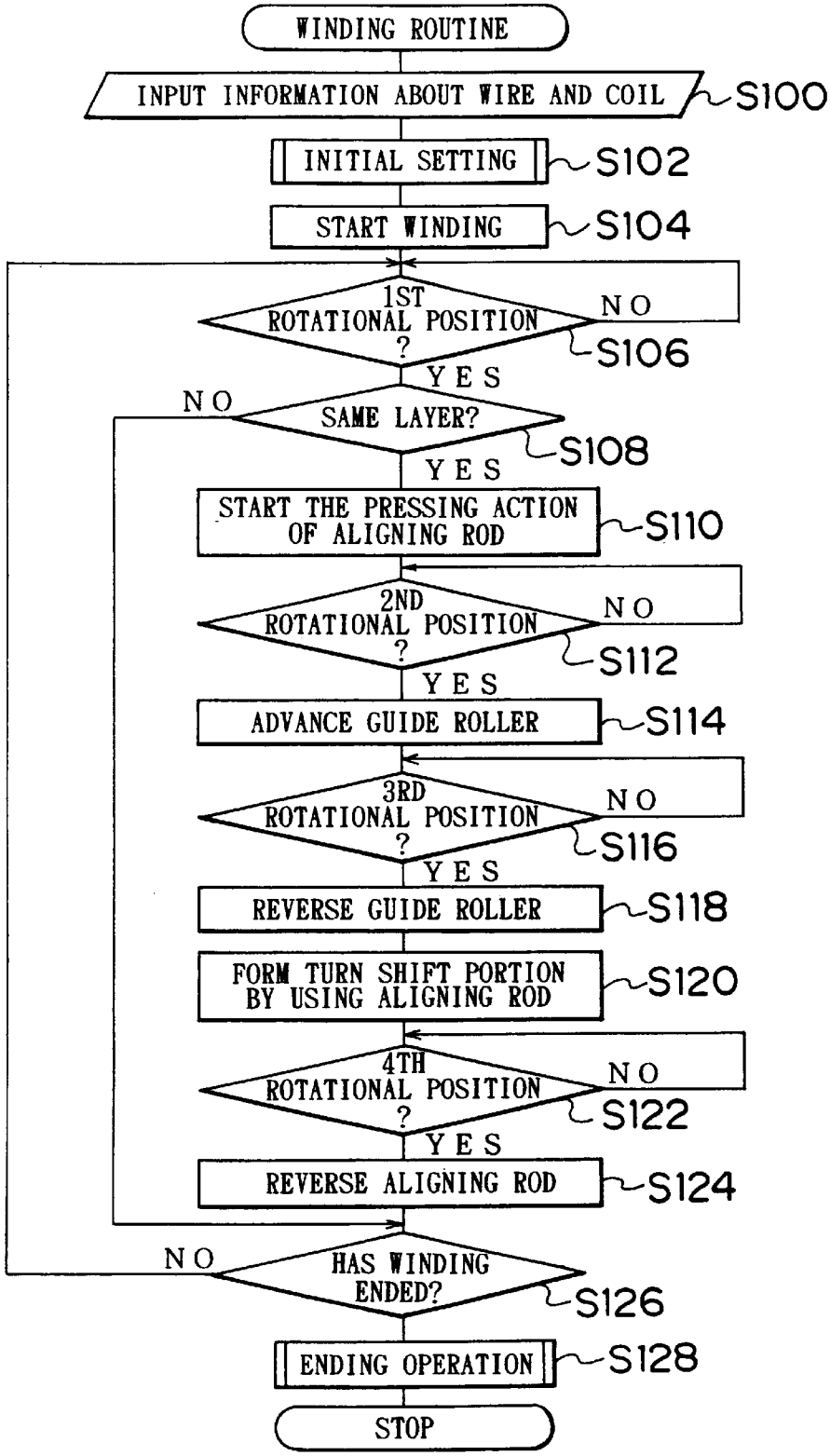
FIG. 5 is a flowchart illustrating an element wire winding routine.

Next described will be the operation of the wire winding apparatus 20 and, particularly, the turn shift of the element wire 12 performed during the winding of the element wire 12. FIG. 5 is a flowchart illustrating an element wire winding routine executed by the ECU 50. This routine is executed when the starter switch 60 is depressed after the winding frame 24 has been connected to the spindle 26 and various pieces of information, such as the thickness or width of the element wire 12, the number of turns of the coil 16 to be formed, and the like, have been input via the operating panel 62.

In step S100, the CPU 52 reads the information about the element wire 12 and the coil 16 input via the operating panel 62. Subsequently in step S102, the CPU 52 performs initial setting based on the input information. In the initial setting, the CPU 52 sets positions of the aligning rod 32 in the vertical directions corresponding to individual layers of winding, amounts of displacement of turn-shift portions of the element wire 12, pitch widths of the aligning rod 32 and the guide roller 40, and other values, based on the width of the element wire 12, the shape of the coil 16 to be formed, the number of turns in each layer, the number of layers, and the like. Subsequently in step S104, the CPU 52 outputs the drive signal to the spindle motor 28 to rotate the winding frame 24, thereby starting to wind the element wire 12 on the winding frame 24.

Figure 6:
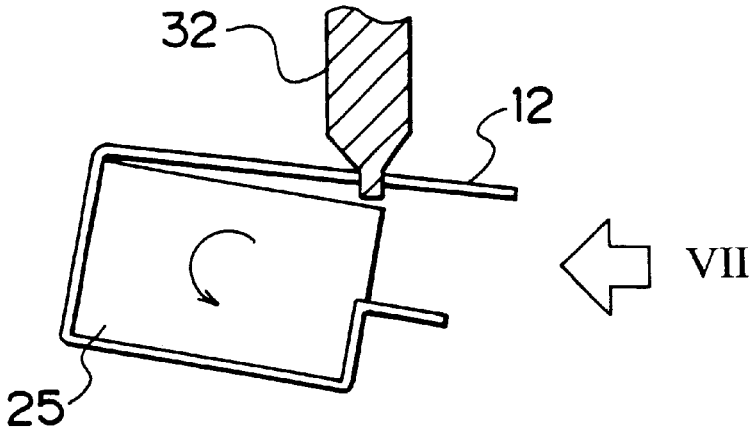
FIG. 6 shows states of a core of the winding frame and of an aligning rod occurring when the winding frame is at a first rotational position.
Figure 7:
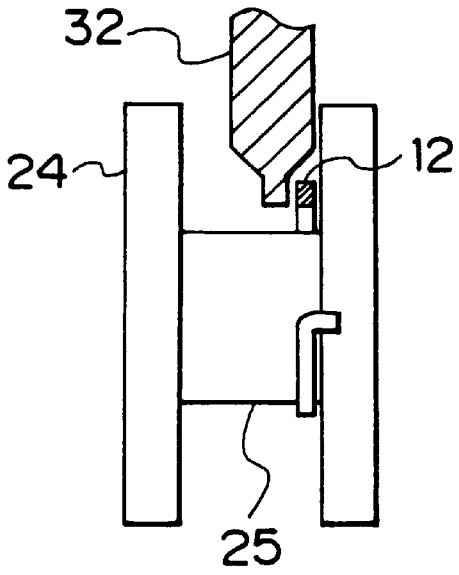
FIG. 7 is a view of the aligning rod and the winding frame at the first rotational position, taken in a direction indicated by an arrow VII in FIG. 6.

After starting winding of the element wire 12, the CPU 52 waits in step S106 for the winding frame 24 to turn to a predetermined first rotational position, based on the signal from the resolver 29 indicating the rotational position of the spindle 26. When the winding frame 24 turns to the first rotational position, the CPU 52 determines in step S108 whether a layer change is needed. If it is determined in step S108 that a layer change is needed, the CPU 52 executes a process of step S126 described later. If it is determined in step S108 that the layer remains unchanged, the CPU 52 executes a process to start a pressing action of the aligning rod 32 in step S110. FIG. 6 shows states of the core 25 of the winding frame 24 and of the aligning rod 32 occurring when the winding frame 24 is at the first rotational position. FIG. 7 is a view of the aligning rod 32 and the winding frame 24 when at the first rotational position, taken in a direction of an arrow VII in FIG. 6. As can be seen in FIGS. 6 and 7, the first rotational position slightly precedes a rotational position in which the winding-start end portion of the element wire 12 is at a rotational angle of 270°. The aligning rod 32 is moved to a position at which the distal end portion of the aligning rod 32 contacts a side portion of the element wire 12 with a small clearance left between the distal end portion of the aligning rod 32 and the core 25 as shown in FIGS. 6 and 7. This operation is performed by the ECU 50 outputting the drive signal to the actuator 34. The position of the aligning rod 32 is determined during the initial setting of step S102. The position of the aligning rod 32 needs to be changed as the winding frame 24 turns. The ECU 50 controls the driving of the actuator 34 so that the aligning rod 32 always assumes positions at which the distal end portion of the aligning rod 32 contacts a side portion of the element wire 12 with a small clearance left between the distal end portion and the core 25, despite the turning of the winding frame 24.

Figure 8:
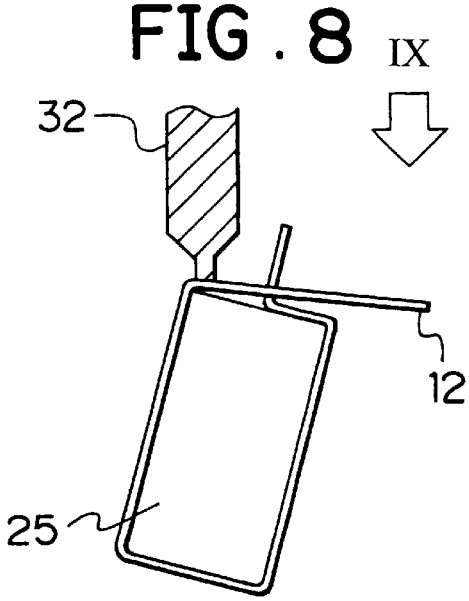
FIG. 8 shows states of the core of the winding frame and of the aligning rod occurring when the winding frame is at a second rotational position.
Figure 9:
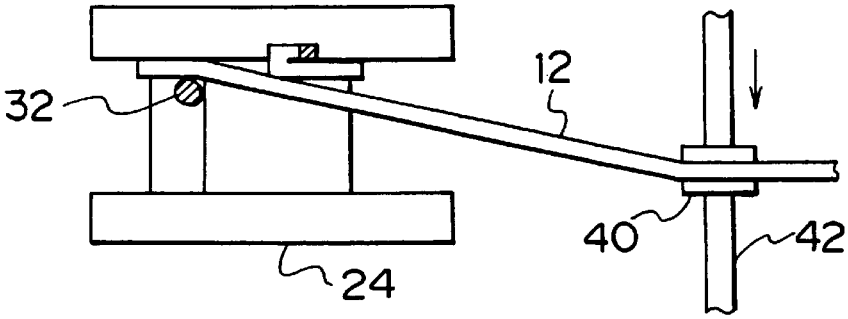
FIG. 9 is a view of a guide roller, the aligning rod and the winding frame at the second rotational position, taken in a direction indicated by an arrow IX in FIG. 8.

Subsequently in step S112, the CPU 52 waits until the winding frame 24 turns to a predetermined second rotational position. Subsequently in step S114, the CPU 52 executes a process to advance the guide roller 40. FIG. 8 shows states of the core 25 of the winding frame 24 and of the aligning rod 32 occurring when the winding frame 24 is at the second rotational position. FIG. 9 is a view of the guide roller 40, the aligning rod 32 and the winding frame 24 when at the second rotational position, taken in a direction indicated by an arrow IX in FIG. 8. As can be seen in FIGS. 8 and 9, the second rotational position is set at 90° from the first rotational position. As indicated in FIG. 9, the guide roller 40 is shifted together with the roller shaft 42 in a direction indicated by an arrow in FIG. 9 (downward in FIG. 9), by such an amount that the element wire 12 can form a new turn on a side of the last turn of the element wire 12 wound on the core 25. The amount of shift of the guide roller 40 is determined during the initial setting. The aligning rod 32 contacts an outer side of the element wire 12 that faces in the direction of turn shift, as shown in FIGS. 8 and 9, so that the turn of the element wire 12 on the core 25 does not deviate in position despite the position shift of the guide roller 40.

Figure 10:
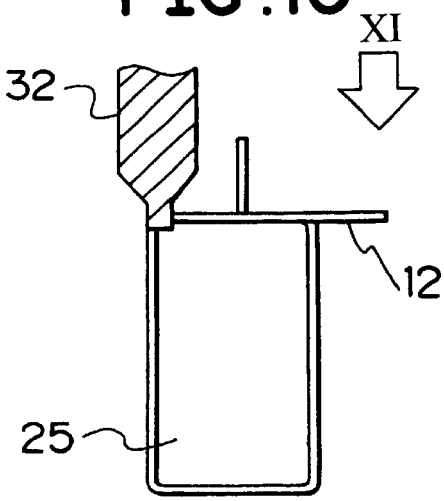
FIG. 10 shows states of the core of the winding frame and of the aligning rod occurring when the winding frame is at a third rotational position.
Figure 11:
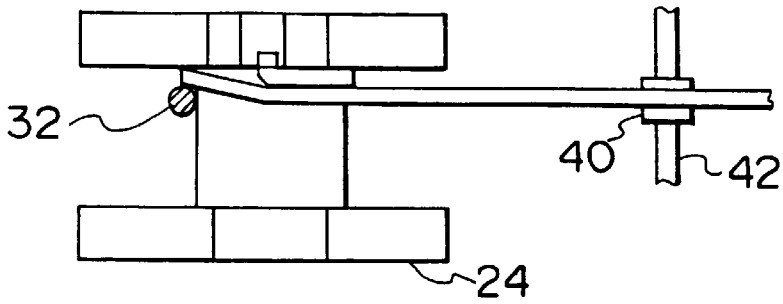
FIG. 11 is a view of the guide roller, the aligning rod and the winding frame at the third rotational position, taken in a direction indicated by an arrow XI in FIG. 10.
Figure 12:
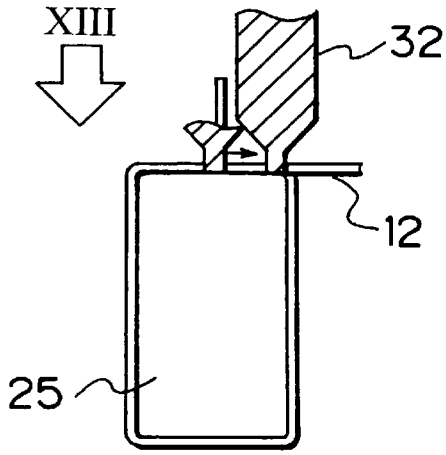
FIG. 12 illustrates an operation of the aligning rod forming a turn shift portion of the element wire.
Figure 13:
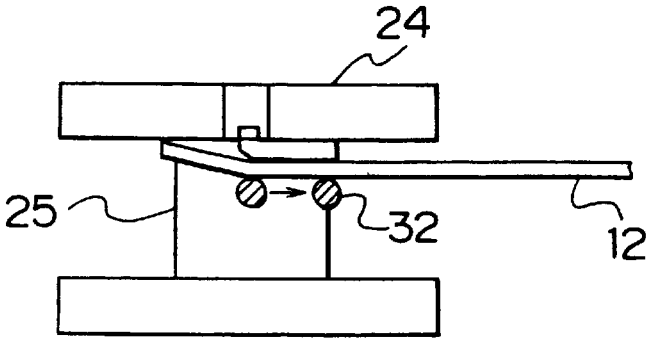
FIG. 13 is a view of the winding frame and of the aligning rod taken in a direction indicated by an arrow XIII in FIG. 12.

In step S116, the CPU 52 waits until the winding frame 24 turns to a predetermined third rotational position. Subsequently in step S118, the CPU 52 executes a process to move the guide roller 40 backwards in position. In step S120, the CPU 52 executes a process to move the aligning rod 32 to form a turn shift portion of the element wire 12. FIG. 10 shows states of the core 25 of the winding frame 24 and of the aligning rod 32 occurring when the winding frame 24 is at the third rotational position. FIG. 11 is a view of the guide roller 40, the aligning rod 32 and the winding frame 24 when at the third rotational position, taken in a direction indicated by an arrow XI in FIG. 10. As can be seen in FIGS. 10 and 11, the third rotational position of the winding frame 24 is predetermined as a position at which the winding-start end portion of the element wire 12 comes to a top center position. The guide roller 40 is reversed to a position that is apart in the turn buildup direction from the position assumed before the aforementioned advancement, by one pitch that is preset to a value equal to the width of the element wire 12. Also, during this operation, the aligning rod 32 remains in contact with the element wire 12 as described above, so that the element wire 12 wound on the core 25 does not deviate. By reversing the guide roller 40 while keeping the aligning rod 32 in contact with the element wire 12, the element wire 12 can be caused to form an S-shaped turn shift portion, depending on the rigidity of the element wire 12 and the tension acting on the element wire 12. FIG. 12 illustrates an operation of the aligning rod 32 forming a turn shift portion of the element wire 12. FIG. 13 is a view of the winding frame 24 and the aligning rod 32 taken in a direction indicated by an arrow XIII in FIG. 12. The aligning rod 32 is moved (from left to right in FIG. 13) along the element wire 12 over the core 25 while the distal end portion of the aligning rod 32 remains in contact with the side face of the element wire 12 and continues applying a pressing force onto the side face of the element wire 12. This operation forms an S-shaped turn shift portion without leaving a gap between turns even if the element wire 12 is a hard wire. The movements of the aligning rod 32 are set during the initial setting.

Figure 14:
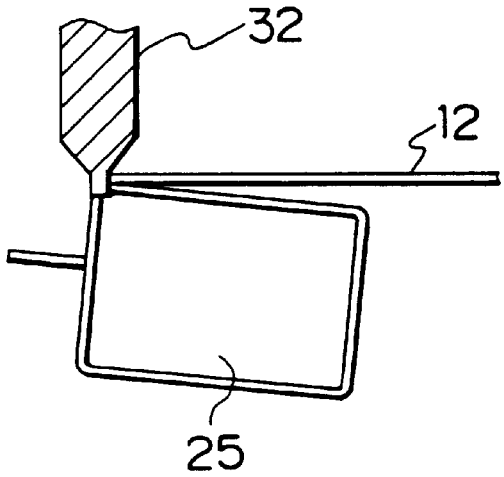
FIG. 14 shows states of the core of the winding frame and of the aligning rod occurring when the winding frame is at a fourth rotational position.
Figure 15:
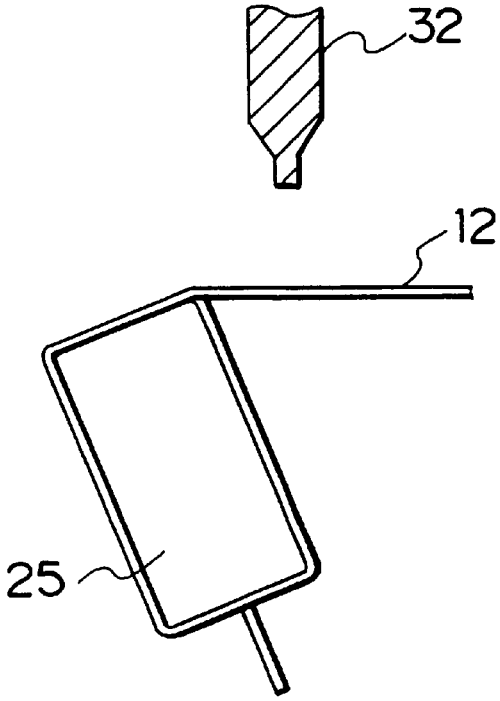
FIG. 15 shows states of the aligning rod and of the core of the winding frame occurring after the reverse of the aligning rod has been completed.

Subsequently in step S122, the CPU 52 waits until the winding frame 24 turns to a predetermined fourth rotational position. In step S124, the CPU 52 executes a process to reverse the aligning rod 32 so as to move the aligning rod 32 out of contact with the element wire 12. FIG. 14 shows states of the core 25 of the winding frame 24 and the aligning rod 32 occurring when the winding frame 24 is at the fourth rotational position. FIG. 15 shows states of the aligning rod 32 and the core 25 of the winding frame 24 occurring after the reversal of the aligning rod 32 has been completed. As can be seen in FIGS. 14 and 15, the fourth rotational position slightly precedes a turning of 90° from the third rotational position. At the fourth rotational position, the aligning rod 32 is raised by the actuator 34 to assume a position apart from the element wire 12 as shown in FIG. 15.

After the reversal of the aligning rod 32 ends, the CPU 52 determines in step S126 whether the winding of the element wire 12 has ended. If the winding has not been completed, the process returns to step S106, in order to continue winding the element wire 12. Completion of the winding is determined by comparing a count indicating the number of rotations of the winding frame 24 with a count of the end of the winding that is set during the initial setting. When it is determined that the winding has ended, the CPU 52 executes ending operations, for example, to cause the winding frame 24 to turn to an end position, and to stop the spindle motor 28, and to display information about the end of the winding on the display 64, and the like in step S128. This routine then ends.

If it is determined in step S108 that a layer change is needed, the CPU 52 omits the turn shift processes (of steps S110 to S124), and rotates the winding frame 24, and determines in step S126 whether the winding has ended. That is, by rotating the winding frame 24 without performing the turn shift processes, the element wire 12 is wound on top of the last turn of the element wire 12 on the core 25, so that a layer change occurs.

The manner of winding the element wire 12 for the first layer on the core 25 has been described above.

The winding for the second and later layers can be accomplished through substantially the same operation as described above, except for a slight difference in the processing of step S110. That is, in step S110, the aligning rod 32 is moved so that the distal end portion of the aligning rod 32 contacts the side face of the element wire 12 while securing a small clearance from the outermost layer of the winding formed around the core 25, that is, the first layer, the second layer or the like. The position at which the distal end portion of the aligning rod 32 contacts the element wire 12 while securing a small clearance from the outermost layer formed around the core 25 is set during the initial setting, based on information including the thickness of the element wire 12 and the like.

The above-described wire winding apparatus 20 of this embodiment is able to quickly form the coil 16 of a desired shape without requiring replacement of a component part during the winding nor requiring a complicated apparatus construction. Furthermore, since the distal end portion of the aligning rod 32 has a shape of a beveled cylinder, the distal end portion of the aligning rod 32 avoids damaging the element wire 12 or the core 25 when contacting the element wire 12.

The wire winding apparatus 20 is able to form the S-shaped turn shift portions of the element wire 12 and to favorably accomplish turn shift and regularly place the turn shift portions by advancing and reversing the guide roller 40 while applying a predetermined tension to the element wire 12. Furthermore, the turn shift portions of the element wire 12 are formed by using the aligning rod 32, so that even if the element wire 12 is a hard wire, favorable turn shift can be accomplished with the turn shift portions regularly aligned. As a result, the wire winding apparatus 20 is able to produce a coil 16 having a tightly packed winding. Therefore, it becomes possible to improve the performance of an appliance (or machine) to which the coil 16 is applied, for example, an electric motor, a power generator, and the like.

Furthermore, in this embodiment, the aligning rod 32 and the actuator 34 are combined as the aligner unit 30. The aligner unit 30 can be easily and inexpensively added to a wire winding apparatus that is not originally equipped with an aligner unit.

If the element wire 12 is relatively soft so that turn shift portions can be formed merely by reversing the guide roller 40, it is possible to omit the operation of forming turn shift portions of the element wire 12 by using the aligning rod 32.

Furthermore, the aligning rod 32 also may be mechanically controlled in accordance with rotation of the winding frame 24.

A wire winding apparatus 120 according to a second embodiment of the invention will be described below.

Figure 16:
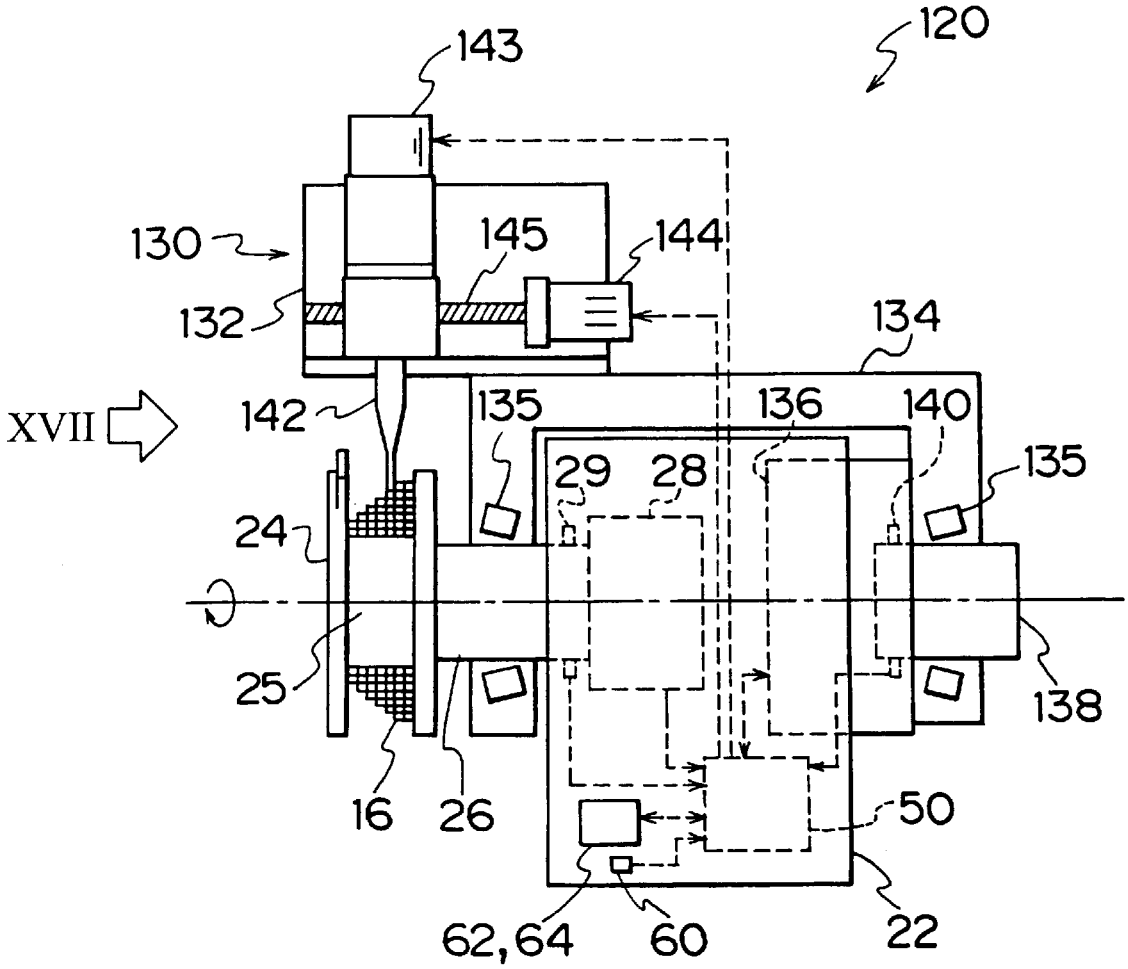
FIG. 16 is a schematic illustration of a construction of a wire winding apparatus according to a second embodiment of the invention.
Figure 17:
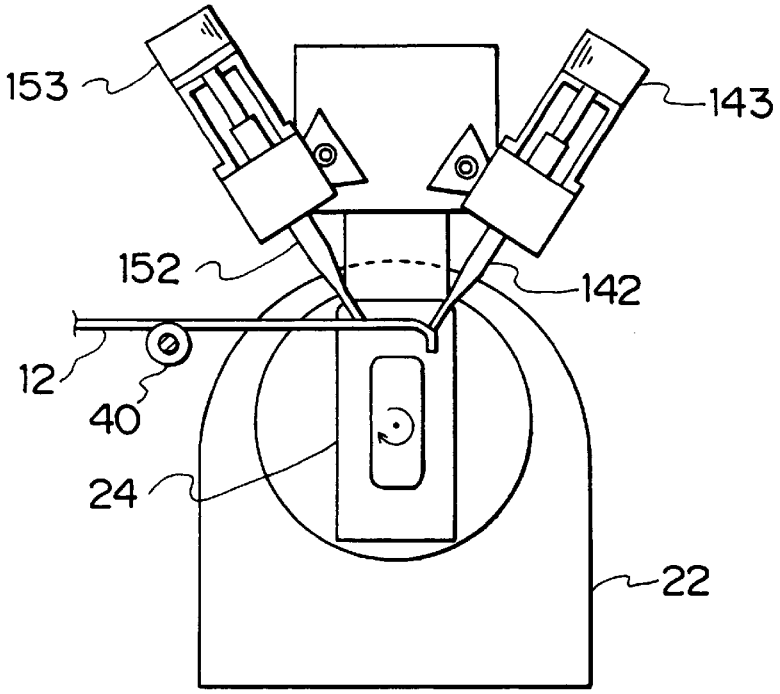
FIG. 17 is a schematic illustration of the construction of the wire winding apparatus viewed in a direction indicated by an arrow XVII in FIG. 16.

FIG. 16 is a schematic illustration of a construction of a wire winding apparatus 120 of the second embodiment of the invention. FIG. 17 is a schematic illustration of the construction of the wire winding apparatus 120 viewed in a direction indicated by an arrow XVII in FIG. 16. Portions and components of the wire winding apparatus 120 comparable to those of the wire winding apparatus 20 of the first embodiment are represented by comparable reference numerals, and will not be described again. As in the first embodiment, an element wire 12 is supplied from a bobbin 10 to a winding frame 24 (see FIGS. 2 and 3).

As shown in FIGS. 16 and 17, an aligner unit 130 in the second embodiment has an aligning rod 142 whose distal end portion contacts a side face of the element wire 12, a layer holding rod 152 that presses and holds the entire layer of turns of the element wire 12 when a turn shift portion of the element wire 12 is formed by cooperation of a guide roller 40 and the aligning rod 142, a support 132 on which the aligning rod 142 and the layer holding rod 152 are mounted, an arm-shaped rotating table 134 on which the support 132 is mounted, and an aligner unit turning motor 136 that is mounted on a base 22 to rotate the rotating table 134.

As shown in FIG. 17, the aligning rod 142 and the layer holding rod 152 are arranged radially about a central axis extending near a rotating axis of the winding frame 24 and are supported to the support 132. The aligning rod 142 and the layer holding rod 152 are provided with actuators 143, 153 so that each rod can be moved in the directions of an axis of the rod. Actuators 144, 154 are further provided for the aligning rod 142 and the layer holding rod 152 so that each rod can be moved in the directions of the rotating axis (i.e., along shaft 145) of the winding frame 24 (FIG. 16). The actuators 143, 144, 153, 154 are connected to an ECU 50 by electrically conductive lines, and the driving of the actuators 143, 144, 153, 154 is controlled by the ECU 50.

The rotating table 134 supporting the support 132 is connected to a rotating shaft 138 of the aligner unit turning motor 136 via bearings 135 so that the rotating table 134 can be rotated relative to the base 22. When the aligner unit turning motor 136 is operated synchronously with the operation of a spindle motor 28, the support 132 supported to the rotating table 134 synchronously rotates together with the aligning rod 142 and the layer holding rod 152. Therefore, the aligning rod 142 or the layer holding rod 152, which contacts the element wire 12, can be moved within a predetermined range of space adjacent to the winding frame 24. Hence, the aligning rod 142 and the layer holding rod 152 can be handled as members that remain motionless relative to rotation of the winding frame 24. The rotating shaft 138 is provided with a resolver 140 for detecting the rotational position of the rotating shaft 138. A detection signal from the resolver 140 is input to the ECU 50.

Figure 18:
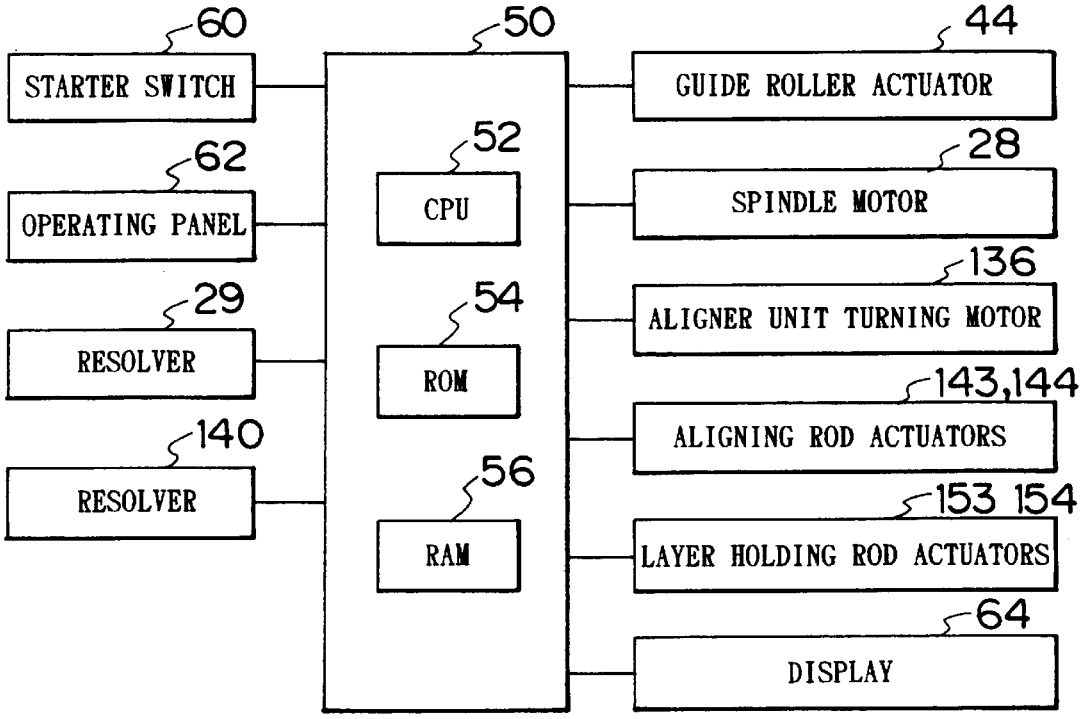
FIG. 18 is a block diagram of electric signals input to and output from an ECU of the wire winding apparatus of the second embodiment.

FIG. 18 is a block diagram of electric signals input to and output from the ECU 50 of the wire winding apparatus 120 of the second embodiment. As indicated in FIG. 18, the ECU 50 receives a rotational position signal from the resolver 140 via input ports, in addition to the signals indicated in FIG. 4. The ECU 50 outputs a drive signal to the aligner unit turning motor 136, and drive signals to the actuators 143, 144, 153, 154 of the aligning rod 142 and of the layer holding rod 152, via output ports.

Figure 19:
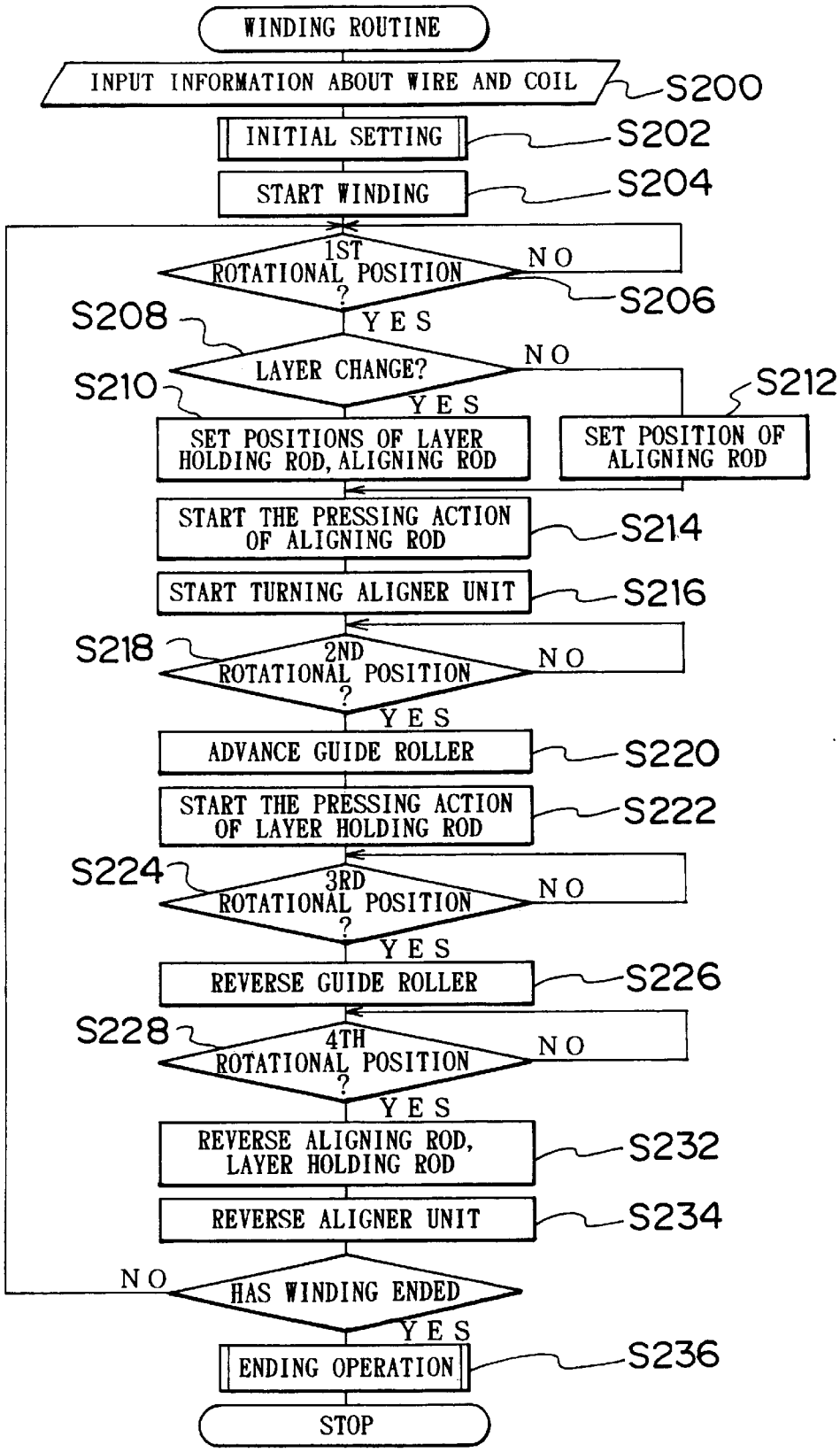
FIG. 19 is a flowchart illustrating an element wire winding routine according to the second embodiment.

Next described will be a turn shift of the element wire 12 performed during the winding of the element wire 12 on the winding frame 24. FIG. 19 is a flowchart illustrating an element wire winding routine executed by the ECU 50. Similar to the wire winding routine (FIG. 5) of the first embodiment, the routine shown in FIG. 19 is executed when a starter switch 60 is depressed after the winding frame 24 has been connected to a spindle 26 and various pieces of information, such as the thickness or width of the element wire 12, the number of turns of the coil 16 to be formed, and the like, have been input via an operating panel 62.

In step S200, the CPU 52 reads the information about the element wire 12 and the coil 16 input via the operating panel 62. Subsequently in step S202, the CPU 52 performs initial setting based on the input information. This initial setting is the same as the processing of step S102 in the routine shown in FIG. 5. That is, the CPU 52 sets positions of the aligning rod 142 and the layer holding rod 152 in the vertical directions corresponding to individual layers of winding, amounts of displacement of turn-shift portions of the element wire 12, pitch widths of the aligning rod 142, of the layer holding rod 152 and of the guide roller 40, and other values, based on the width of the element wire 12, the shape of the coil 16 to be formed, the number of turns in each layer, the number of layers, and the like. In step S204, which follows the initial setting, the CPU 52 starts the winding of the element wire 12 on the winding frame 24.

Subsequently in step S206, the CPU 52 waits for the winding frame 24 to turn to a predetermined first rotational position, based on the signal from the resolver 29 indicating the rotational position of the spindle 26. When the winding frame 24 turns to the first rotational position, the CPU 52 determines in step S208 whether a layer change is needed. If it is determined in step S208 that a layer change is needed, the CPU 52 sets, in step S210, new positions of the aligning rod 142 and the layer holding rod 152 that are to be assumed after the layer change. If it is determined in step S208 that a layer change is not needed, the CPU 52 sets, in step S212, a new position of the aligning rod 142 without setting a new position of the layer holding rod 152.

Figure 20:
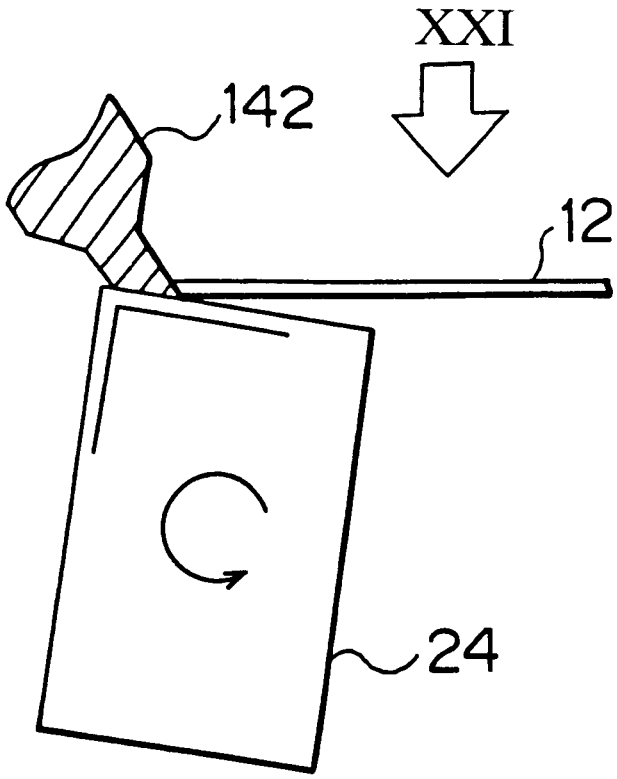
FIG. 20 shows states of the aligning rod and of the winding frame occurring when the winding frame is at a first rotational position.
Figure 21:
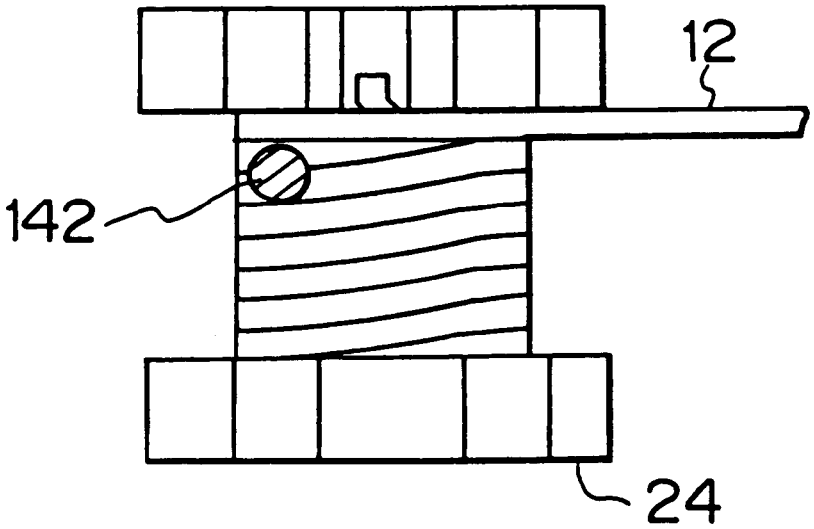
FIG. 21 is a view of the winding frame and of the aligning rod taken in a direction indicated by an arrow XXI in FIG. 20.

After the position setting of the aligning rod 142 alone or both the aligning rod 142 and the layer holding rod 152, the CPU 52 executes a process to start a pressing action of the aligning rod 142 in step S214. FIG. 20 shows states of the aligning rod 142 and of the winding frame 24 occurring when the winding frame 24 is at the first rotational position, where the first layer winding is about to be completed and a layer change to the second layer is about to be performed. FIG. 21 is a view of the winding frame 24 and the aligning rod 142 taken in a direction indicated by an arrow XXI in FIG. 20. As indicated in FIG. 21, the first rotational position is set as a position slightly preceding the completion of the first layer winding of the element wire 12. In the pressing action of the aligning rod 142, the distal end portion of the aligning rod 142 comes into contact with a side portion of the element wire 12. This action is caused by the ECU 50 outputting the drive signals to the actuators 143, 144. In this case, the position of the aligning rod 142 is set by the processing of step S210. In the processing of step S210 or S212, the present winding position of the element wire 12 is stored in the form of, for example, "the nth turn of the mth layer", based on the information regarding the coil 16 and the like and the information regarding the number of turns of the element wire 12 wound. Based on such information, the CPU 52 determines the position of the present turn shift portion of the element wire 12, and sets a position of the aligning rod 142.

After starting the pressing action of the aligning rod 142, the CPU 52 executes a process to start to rotate the aligner unit 130 synchronously with the rotation of the winding frame 24 in step S216. This process is executed by the ECU 50 outputting the drive signal to the aligner unit turning motor 136. When the aligner unit 130 is rotated synchronously with the rotation of the winding frame 24, the aligning rod 142 rotates synchronously with the winding frame 24. Therefore, in a rotating coordinate system, the aligning rod 142 is held stationary at a position indicated in FIG. 21.

Figure 22:
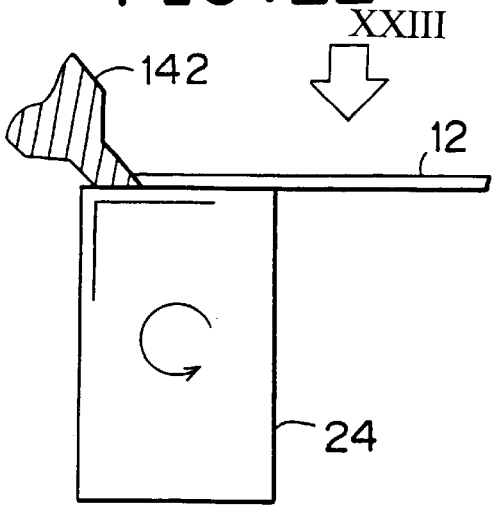
FIG. 22 shows states of the aligning rod and of the winding frame occurring when the winding frame is at a second rotational position.
Figure 23:
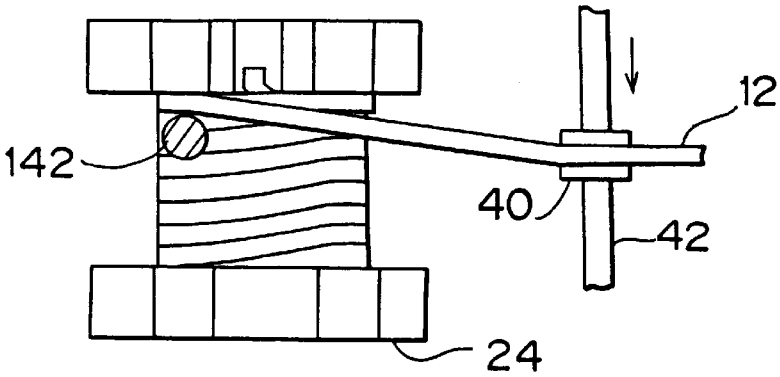
FIG. 23 is a view of the guide roller, the winding frame and the aligning rod taken in a direction indicated by an arrow XXIII in FIG. 22.

Subsequently in step S218, the CPU 52 waits until the winding frame 24 turns to a predetermined second rotational position. Subsequently in step S220, the CPU 52 executes a process to advance the guide roller 40. FIG. 22 shows states of the aligning rod 142 and the winding frame 24 occurring when the winding frame 24 is at the second rotational position. FIG. 23 is a view of the guide roller 40, the winding frame 24 and the aligning rod 142 taken in a direction indicated by an arrow XXIII in FIG. 22. As can be seen from the drawings, the second rotational position is set at a small rotational angle from the first rotational position. The advancement of the guide roller 40 is performed substantially in the same manner as in step S114 of the routine illustrated in FIG. 5. The aligning rod 142 contacts an outer side of the element wire 12 that faces in the direction of turn shift, so that the element wire 12 wound on the core 25 does not deviate in position despite the advancement of the guide roller 40.

Figure 24:
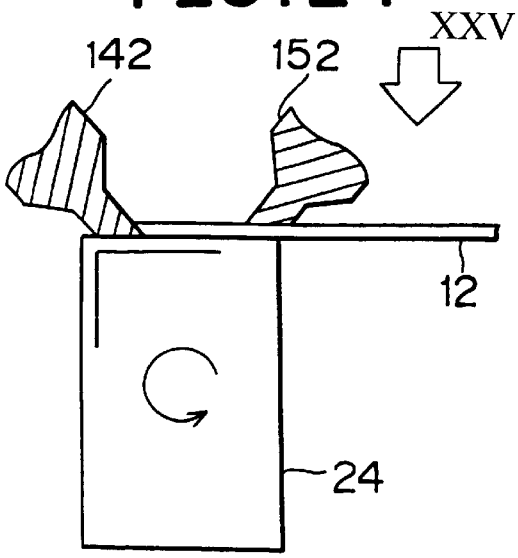
FIG. 24 shows states of the winding frame, the aligning rod and the layer holding rod occurring when the pressing action of the layer holding rod is started.
Figure 25:
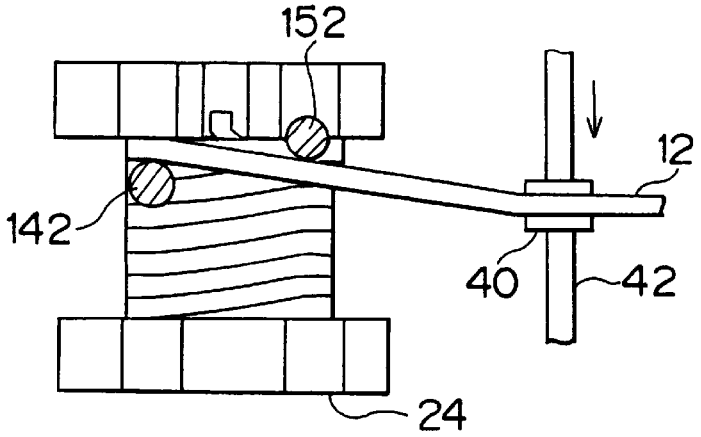
FIG. 25 is a view of the winding frame, the aligning rod, the layer holding rod and the guide roller taken in a direction indicated by an arrow XXV in FIG. 24.
Figure 26:
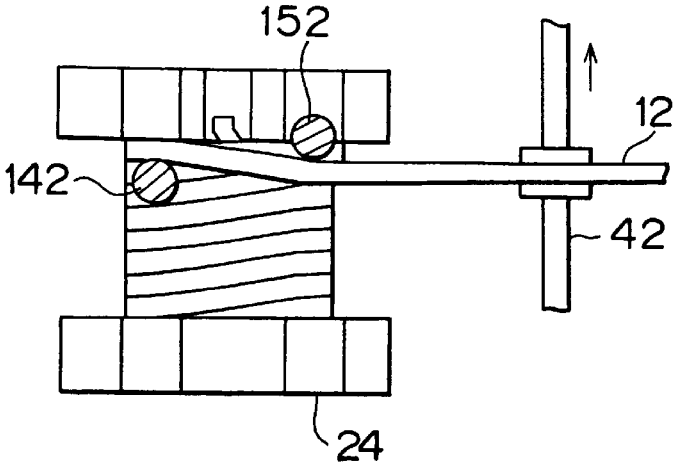
FIG. 26 shows states of the winding frame, the aligning rod, the layer holding rod and the guide roller occurring when the winding frame is at a third rotational position.
Figure 27:
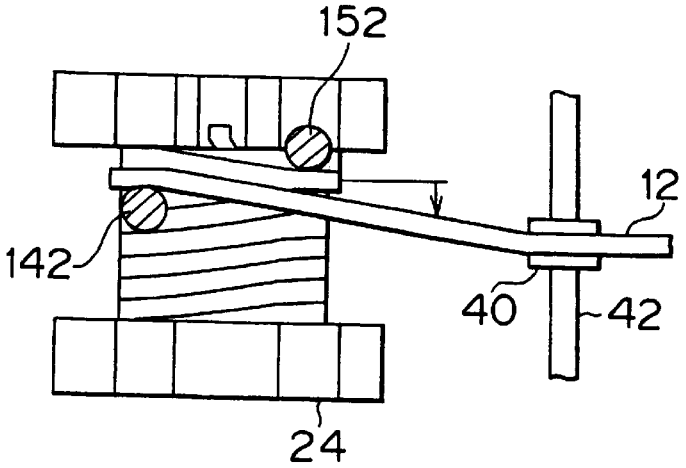
FIG. 27 shows states of the winding frame and of the layer holding rod occurring when the second row of winding is formed.

Subsequently to the advancement of the guide roller 40, the CPU 52 executes a processing to start the pressing action of the layer holding rod 152 in step S222. FIG. 24 shows states of the winding frame 24, the aligning rod 142 and the layer holding rod 152 occurring when the pressing action of the layer holding rod 152 is started. FIG. 25 is a view of the winding frame 24, the aligning rod 142, the layer holding rod 152 and the guide roller 40 taken in a direction indicated by an arrow XXV in FIG. 24. Since the pressing action of the layer holding rod 152 is performed subsequently to the advancement of the guide roller 40, the rotational position of the winding frame 24 at the time of the pressing action of the layer holding rod 152 is approximately the same as the rotational position of the winding frame 24 at the time of the advancement of the guide roller 40. In the pressing action of the layer holding rod 152, the layer holding rod 152 is moved to a position at which a distal end portion of the layer holding rod 152 contacts a side of the element wire 12 at the second row of the new layer. This action is performed by the ECU 50 outputting the drive signals to the actuators 153, 154 of the layer holding rod 152. Since the layer change from the first layer to the second layer is performed in the process of forming the pyramidal coil 16 in this description, the layer holding rod 152 is set to a position where the layer holding rod 152 presses a side of the element wire 12 that faces the end of the winding frame 24 and that has been spaced by the width of the element wire 12 from the end of the winding frame 24 by the advancement of the guide roller 40. When a layer change is not needed, for example, when the third or later turn of the second layer is wound, the layer holding rod 152 is also set to the position (substantially the same as the position indicated in FIG. 25) near the starting end of the layer presently wound, as illustrated in FIG. 26. The reason why a position of the layer holding rod 152 is set for a layer change (step S210) and a position of the layer holding rod 152 is not set when a layer change is not needed (step S212) is that while the winding layer of the element wire 12 remains the same, the position of the layer holding rod 152 is not changed.

In step S224, the CPU 52 waits until the winding frame 24 turns to a predetermined third rotational position. Subsequently in step S226, the CPU 52 executes a process to reverse the guide roller 40, thereby forming an S-shaped turn shift portion of the element wire 12. FIG. 26 shows states of the winding frame 24, the aligning rod 142, the layer holding rod 152 and the guide roller 40 occurring when the winding frame 24 is at the third rotational position. During the reversal of the guide roller 40, a force acts on the element wire 12 wound on the winding frame 24, in a direction toward the starting end of the present layer (upward in FIG. 26). However, since the starting end of the present layer is held by the layer holding rod 152, the turns of the element wire 12 wound on the winding frame 24 do not collapse.

Figure 28:
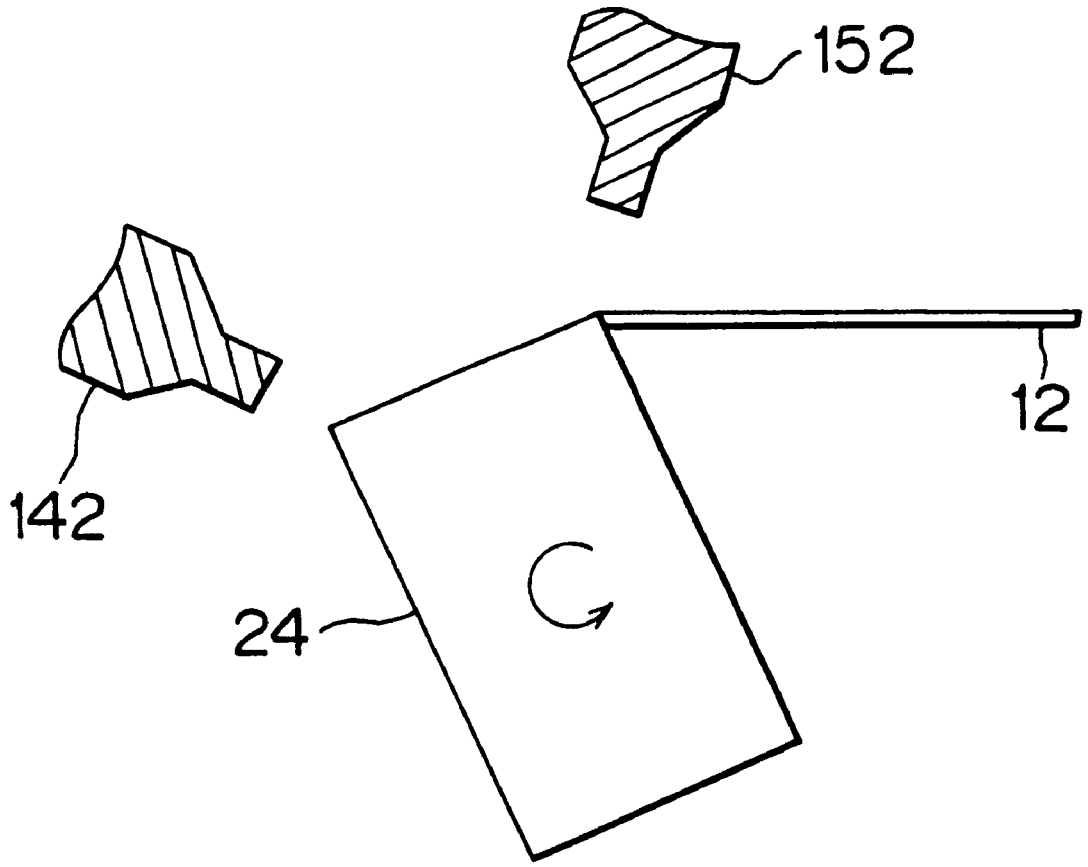
FIG. 28 shows states of the winding frame, the aligning rod and the layer holding rod occurring when the winding frame is at a fourth rotational position.

In step S228, the CPU 52 waits until the winding frame 24 turns to a predetermined fourth rotational position. In step S230, the CPU 52 executes a process to reverse the aligning rod 142 so as to discontinue the contact of the aligning rod 142 with the element wire 12 and to reverse the layer holding rod 152 so as to discontinue the pressing hold of the layer by the layer holding rod 152. In step S232, the CPU 52 executes a processing to return the aligner unit 130, which has been rotating synchronously with the winding frame 24, to the original position. Therefore, when the winding frame 24 turns to the first rotational position again, the pressing action of the aligning rod 142 can be caused. FIG. 28 shows states of the winding frame 24, the aligning rod 142 and the layer holding rod 152 occurring when the winding frame 24 is at the fourth rotational position. As indicated in FIG. 28, the fourth rotational position is set at a rotational angle of about 30° from the third rotational position. At the fourth rotational position, the aligning rod 142 and the layer holding rod 152 are raised apart from the winding frame 24 by the actuators 143, 153.

When the reversal of the aligning rod 142 and the layer holding rod 152 ends, the CPU 52 determines in step S234 whether the winding of the element wire 12 has ended. If the winding has not ended, the process returns to the step S206 in order to continue the winding. When it is determined that the winding has ended, the CPU 52 executes ending operations, for example, to cause the winding frame 24 to turn to an end position, and to stop the spindle motor 28, and displays information about the end of the winding on the display 64, and the like in step S236. This routine then ends.

The manner of forming the second and later turns of the second layer around the winding frame 24 has been described above. The winding of the element wire 12 for the third and later layers is also performed by setting positions of the aligning rod 142 and of the layer holding rod 152 in steps 210 and S212, and performing the pressing action of the aligning rod 142 and the pressing action of the layer holding rod 152 in substantially the same manner as in the second layer. In the formation of the pyramidal coil 16, the starting end of the third or fifth layer contacts an end of the winding frame 24, so that the pressing action of the layer holding rod 152 is not performed for the third of fifth layer or the like.

The above-described second embodiment is able to quickly and regularly wind the element wire 12 to form the coil 16 of a desired shape without requiring replacement of a component part during the wire winding process, similarly to the first embodiment. Furthermore, in the second embodiment, the layer holding rod 152 holds the starting end of the second row and beyond of each layer during the reversal of the guide roller 40, so that the turns of the element wire 12 around the winding frame 24 do not collapse when a turn shift portion of the element wire 12 is formed. Therefore, it becomes easy to form a thick or wide rectangular wire into a trapezoidal coil or a pyramidal coil.

The foregoing wire winding apparatus of the embodiments may also omit the rolling rollers 36, 38 and use other members, for example, the element wire bobbin 10 or the guide roller 40, to apply a predetermined tension to the element wire 12.

Although in the foregoing embodiments, the guide roller 40 is movable together with the roller shaft 42 in the directions of the rotating axis of the winding frame 24, it is also possible to employ a construction in which the guide roller 40 alone is movable. The guide roller 40 also may be moved in an arcuate manner as well as in the directions of the rotating axis as long as the element wire 12 is angled in accordance with an angle determined in the initial setting.

While the present invention has been described with reference to preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the present invention.

What is claimed is:

1. A wire winding apparatus for forming a coil by winding an element wire, comprising:

a rotatable winding frame on which the element wire is wound during rotation of the winding frame;

an element wire support that is movable in a direction of a rotation axis of the winding frame, and that supports the element wire and applies a predetermined tension to the element wire;

a turn shift portion shaper that contacts the element wire and forms a turn shift portion in the element wire by utilizing the tension applied to the element wire by the element wire support, when the element wire is shifted from a turn to another turn during winding of the element wire around the winding frame;

a turn shift portion holder that holds the turn shift portion of the element wire located at a winding starting end of the element wire when the turn shift portion is formed by at least the turn shift portion shaper; and a supporting rotator that supports the turn shift portion shaper and the turn shift portion holder and that is capable of rotating the turn shift portion shaper and the turn shift portion holder about the rotation axis of the winding frame, wherein:

the turn shift portion shaper includes a rod-shaped element wire contact portion that contacts the element wire;

the turn shift portion holder has a starting end contact portion that contacts the winding starting end; and the turn shift portion shaper and the turn shift portion holder are arranged about the rotation axis of the winding frame, with a predetermined rotational angle formed between the turn shift portion shaper and the turn shift portion holder.

2. A wire winding apparatus according to claim 1, further comprising:

a rotational position detector that detects a rotational position of the winding frame; and a controller that controls driving of the element wire support, driving of the turn shift portion shaper, driving of the turn shift portion holder, and driving of the supporting rotator, based on the rotational position detected by the rotational position detector.

3. A wire winding apparatus according to claim 2, wherein:

the controller controls the driving of the turn shift portion shaper so that the turn shift portion shaper contacts and presses the element wire in such a direction as to hold the element wire wound around the winding frame, when the rotational position of the winding frame detected by the rotational position detector coincides with a position where a turn shift of the element wire is to be performed;

the controller controls the driving of the turn shift portion holder so that the starting end contact portion contacts the winding starting end; and the controller controls the driving of the element wire support so that the element wire is moved in a direction of the turn shift of the element wire so as to form a predetermined angle with respect to the rotation axis of the winding frame, and so that the element wire is then reversed to an angle of about 90° with respect to the rotation axis of the winding frame.

4. A wire winding apparatus according to claim 3, wherein the controller controls the driving of the turn shift portion holder so that the starting end contact portion contacts the winding starting end, at least when the element wire support returns to the angle of about 90° after forming the predetermined angle.

5. A wire winding apparatus according to claim 3, wherein the controller controls the driving of the supporting rotator so that the turn shift portion shaper and the turn shift portion holder rotate about an axis coinciding with the rotation axis of the winding frame synchronously with rotation of the winding frame during a turn shift operation of the element wire support.

6. A method for forming a coil by winding an element wire, comprising:

rotating a winding frame on which the element wire is wound;

supporting the element wire with an element wire support and applying a predetermined tension to the element wire, the element wire support being movable in a direction of a rotation axis of the winding frame;

forming a turn shift portion in the element wire with a turn shift portion shaper by utilizing the tension applied to the element wire, when the element wire is shifted from a turn to another turn during winding of the element wire around the winding frame;

detecting a rotational position of the winding frame;

controlling driving of the element wire support and driving of the turn shift portion shaper based on the detected rotational position; and holding the turn shift portion of the element wire located at a winding starting end of the element wire with a turn shift portion holder when the turn shift portion is formed by at least the turn shift portion shaper;

wherein the turn shift portion shaper and the turn shift portion holder are movable in a first direction of the rotation axis of the winding frame, in a second direction toward and away from the winding frame, and are rotatable in a third direction around the winding frame.

7. A method according to claim 6, wherein at least a portion of the turn shift portion shaper contacts the element wire and has a shape of a rod and extends substantially perpendicular to the winding frame rotation axis.

8. A method according to claim 6 wherein:

the driving of the turn shift portion shaper is controlled so that the turn shift portion shaper contacts and presses the element wire in such a direction as to hold the element wire wound around the winding frame, when the detected rotational position of the winding frame coincides with a position where a turn shift of the element wire is to be performed; and the driving of the element wire support is controlled so that the element wire is moved in a direction of the turn shift of the element wire so as to form a predetermined angle with respect to the rotation axis of the winding frame, and so that the element wire is then reversed to an angle of about 90° with respect to the rotation axis of the winding frame.

9. A method according to claim 8, wherein the driving of the element wire support is controlled, and then the driving of the turn shift portion shaper is controlled so that the turn shift portion shaper moves to an end portion of the turn shift portion while remaining in contact with the element wire.

10. A method according to claim 6, wherein:

the turn shift portion shaper includes a rod-shaped element wire contact portion that contacts the element wire;

the turn shift portion holder has a starting end contact portion that contacts the winding starting end; and the turn shift portion shaper and the turn shift portion holder are arranged about the rotation axis of the winding frame, with a predetermined rotational angle formed between the turn shift portion shaper and the turn shift portion holder.

11. A coil produced by the method of claim 6.

12. A method for forming a coil by winding an element wire, comprising:

rotating a winding frame on which the element wire is wound;

supporting the element wire with an element wire support and applying a predetermined tension to the element wire, the element wire support being movable in a direction of a rotation axis of the winding frame;

forming a turn shift portion in the element wire with a turn shift portion shaper by utilizing the tension applied to the element wire, when the element wire is shifted from a turn to another turn during winding of the element wire around the winding frame;

holding the turn shift portion of the element wire located at a winding starting end of the element wire with a turn shift portion holder when the turn shift portion is formed by at least the turn shift portion shaper; and rotating the turn shift portion shaper and the turn shift portion holder about the rotation axis of the winding frame when the turn shift portion is formed by at least the turn shift portion shaper, wherein:

the turn shift portion shaper includes a rod-shaped element wire contact portion that contacts the element wire;

the turn shift portion holder has a starting end contact portion that contacts the winding starting end; and the turn shift portion shaper and the turn shift portion holder are arranged about the rotation axis of the winding frame, with a predetermined rotational angle formed between the turn shift portion shaper and the turn shift portion holder.

13. Apparatus for controlling the position of an element wire as the element wire is formed into a coil by a winding apparatus that uses a rotatable winding frame on which the element wire is wound during rotation of the winding frame, the apparatus comprising:

an element wire guide that is movable in a direction of a rotation axis of the winding frame, and that guides the element wire while a predetermined tension is applied to the element wire;

an elongated turn shift portion shaping member that is movable into contact with the element wire to form a turn shift portion in the element wire by utilizing the predetermined tension applied to the element wire, when the element wire is shifted from a turn to another turn during winding of the element wire around the winding frame;

a controller that controls driving of the element wire guide and driving of the elongated turn shift portion shaping member based on a rotational position of the winding frame; and a turn shift portion holder that holds the turn shift portion of the element wire located at a winding starting end of the element wire when the turn shift portion is formed by at least the elongated turn shift portion shaping member;

wherein the elongated turn shift portion shaping member and the turn shift portion holder are movable in a first direction of the rotation axis of the winding frame, in a second direction toward and away from the winding frame, and are rotatable in a third direction around the winding frame.

14. Apparatus according to claim 13, wherein the elongated turn shift portion shaping member is movable within a predetermined range of space adjacent to the winding frame.

15. Apparatus according to claim 13, wherein at least a portion of the elongated turn shift portion shaping member that contacts the element wire has a shape of a rod.

16. Apparatus according to claim 13, wherein:

the controller controls the driving of the elongated turn shift portion shaping member to press the element wire in such a direction as to hold the element wire wound around the winding frame, when the rotational position of the winding frame coincides with a position where a turn shift of the element wire is to be performed; and the controller controls the driving of the element wire guide so that the element wire is moved in a direction of the turn shift of the element wire so as to form a predetermined angle with respect to the rotation axis of the winding frame, and so that the element wire is then reversed to an angle of about 90° with respect to the rotation axis of the winding frame.

17. Apparatus according to claim 13, wherein:

the elongated turn shift portion shaping member includes a rod-shaped element wire contact portion that contacts the element wire;

the turn shift portion holder has a starting end contact portion that contacts the winding starting end; and the elongated turn shift portion shaping member and the turn shift portion holder are arranged about the rotation axis of the winding frame, with a predetermined rotational angle formed between the elongated turn shift portion shaping member and the turn shift portion holder.

* * * * *